US006550528B1

(12) United States Patent
Ichiki et al.

(10) Patent No.: US 6,550,528 B1
(45) Date of Patent: Apr. 22, 2003

(54) HOT-TOP TYPE CONTINUOUS CASTING MACHINE FOR HOLLOW BILLET

(75) Inventors: Takahiko Ichiki, Tokyo (JP); Nobuharu Shigemitsu, Tokyo (JP); Katsumi Miyamoto, Tokyo (JP); Masahiro Ito, Tokyo (JP)

(73) Assignee: The Furukawa Electric Co., Ltd. (JP)

( * ) Notice: Subject to any disclaimer, the term of this patent is extended or adjusted under 35 U.S.C. 154(b) by 3 days.

(21) Appl. No.: 09/698,759

(22) Filed: Oct. 26, 2000

(51) Int. Cl.[7] ..... B22D 11/124
(52) U.S. Cl. ..... 164/444; 164/421
(58) Field of Search ..... 164/421, 464, 164/465, 444, 487, 485, 443

(56) References Cited

U.S. PATENT DOCUMENTS 4,437,508 A * 3/1984 Pryor et al. ..... 164/418
4,531,569 A * 7/1985 Fritscher ..... 164/421
4,546,816 A * 10/1985 Schwarz ..... 164/421
4,875,519 A * 10/1989 Ishii et al. ..... 164/421
5,052,469 A * 10/1991 Yanagimoto et al. ..... 164/415

FOREIGN PATENT DOCUMENTS

JP 62089549 A * 4/1987
JP 1630402 1/1989
JP S62-107749 5/1997

* cited by examiner

*Primary Examiner*—M. Alexandra Elve
*Assistant Examiner*—Kevin McHenry
(74) *Attorney, Agent, or Firm*—Cantor Colburn LLP

(57) ABSTRACT

Provided is a hot-top type continuous casting machine for stably producing hot metal hollow billets having a high quality, which comprises:

(a) a molten metal holding part fed therein with molten metal;

(b) a ring mold arranged being connected to the molten metal holding part; and (c) a core inserted in the hollow mold from thereabove, and composed of a low heat-conductive upper core and a high heat-conductive lower core to be cooled by coolant circulating therethrough.

9 Claims, 5 Drawing Sheets

HOT-TOP TYPE CONTINUOUS CASTING MACHINE FOR HOLLOW BILLET

FIELD OF THE INVENTION

The present invention relates to a hot-top type continuous casting machine for hollow billets, which can stably cast hollow billets made of nonferrous metal such as, in particular, aluminum alloy including aluminum, with a high degree of quality, and in addition in particular to an improved core adapted to be used in a mold for casting such hollow billets.

RELATED ART

Metal billets are used as materials for extrusion of a pipe, using a mandrel, which are advantageous since they offer a higher yield for extrusion in comparison with that of solid billets.

In order to produce the above-mentioned hollow billets, there has been used a hot-top type continuous casting machine or a direct chill casting machine.

Among them, as shown in FIG. 1, the hot-top type continuous casting machine is adapted to retain, in a molten metal holding part 2 formed of refractory materials, molten metal 3 such as aluminum alloy, which is continuously transferred from a holding furnace (not shown), through a trough 20, and the thus retained molten metal 3 is then continuously cast into a hollow billet 1 through the intermediary of a casting part 4 located underneath the molten metal holding part 2 and composed of an ring mold 6 and a core 31. This continuous casting machine in provided with a feeder head, and accordingly, the thus produced hollow billet may have a high degree of interior quality. The ring mold 6 constituting the above-mentioned casting part 4 defines the outer peripheral part of the hollow billet 1, and the core 31 defines the inner peripheral part of the hollow billet 1. The core 31 is attached to a support bar 21 located on the upper surface of the molten metal holding part 2.

The core 31 has conventionally made of aluminum alloy or graphite as disclosed in Japanese Patent Application No. S62-107749.

However, a core made of aluminum alloy has such a structure that water is injected, direct to the inner peripheral surface of a hollow billet from the lower end part of the core, and further, it is high heat conductive. Thus, a solidified shell is formed at the inner surface 5 of the ring billet on a relatively earlier stage, and this solidified shell is then remelted by molten metal in the molten metal holding part 2. Thus, the molten metal which has been remelted gives rise to an uneven surface, possibly causing leakage of the molten metal.

Meanwhile, Japanese patent Application No. S63-273553 discloses a core made of graphite, silicon nitride or the like. The graphite core has a relative low thermal conductivity so that the position where the formation of a solidified shell is initiated is likely to vary depending upon a casting condition, and accordingly, a hollow billet 1 with a high degree of quality cannot be stably produced. Further, since the outer surface of the graphite core 31 is worn with the time, resulting in ununiform cooling by the core, which would cause a defect in the inner peripheral surface of the hollow billet 1. Thus, there would be finally resulted a risk of leakage of molten metal.

Thus, there has been proposed a core having an upper part made of a refractory material and a lower part made of metal, and adapted to directly inject cooling water from the lower end part of the core onto the inner peripheral surface of a hollow billet (refer to, for example, Japanese patent No. 1630402).

However, this core is always subjected to such a risk that it is drawn into the hollow billet due to solidification contraction of the hollow part of the hollow billet. Should the core be drawn into the hollow billet, molten metal in the molten metal holding part would attack the above-mentioned injected cooling water thereover, resulting in the risk of occurrence of steam explosion. Thus, this core has not yet been practically used.

SUMMARY OF THE INVENTION

Accordingly, an object of the present invention is to provide a hot-top type continuous casting machine which can stably cast a hollow billet having a high degree of quality, and in particular, to provide an improved core used in an ring mold for casting a hollow billet.

To the end, according to a first aspect of the present invention, there is provided a hot-top type continuous casting machine for casting a hollow billet, comprising: (a) a molten metal holding part into which molten metal is fed; (b) an ring mold arranged being connected to the molten metal holding part; and (c) a core inserted in the ring mold from the top of the later so as to define the inner wall of the hollow billet, and composed of an upper core which is low heat-conductive, and a lower core which is high heat-conductive and which is adapted to be cooled by cooling medium circulated therethrough.

According to a second aspect of the present invention, there is provided a hot-top type continuous casting machine in which the boundary part between the upper and lower cores is set at a heightwise position which is substantially equal to that of the ring mold.

According to a third aspect of the present invention, there is provided a hot-top type continuous casting machine in which both upper and lower cores are gradually tapered from the upper part to the lower part thereof with a predetermined gradient.

According to a fourth aspect of the present invention, there is provided a hot-top type continuous casting machine in which the high heat-conductive core is cooled by coolant circulating therethrough.

According to a fifth aspect of the present invention, there is provided a hot-top type continuous casting machine which is provided with a means for feeding lubrication oil onto the outer surface of the core in the boundary part between the low conductive upper core and the high conductive lower core.

According to a sixth aspect of the present invention, there is provided a hot-top type continuous casting machine in which the above-mentioned lubrication oil is rape seed oil or castor oil.

According to a seventh aspect of the present invention, there is provided a hot-top type continuous casting machine which is used for casting aluminum alloy.

According to an eighth aspect of the present invention, there is provided a core adapted to be used in a hot-top type continuous casting machine for casting a hollow billet, comprising (a) a low heat-conductive upper core and a high heat-conductive lower core; (b) a coolant supply pipe, and a coolant discharge pipe for discharging the coolant, which are extended through the core, (c) the coolant fed from the coolant supply pipe being discharged from the outside from the coolant discharge pipe after cooling the interior of the high heat-conductive core, and (d) means for feeding lubrication oil onto the outer surface of the core, being provided in the boundary part between the upper core and the lower core.

According to a ninth aspect of the present invention, there is provided a core used in a hot-top type continuous casting machine, in which the core is made of a heat-insulation board.

According to a tenth aspect of the present invention, there is provided a core used in a hot-top type continuous casting machine, in which the core is made of either aluminum alloy including AA6061 alloy, or copper alloy including Cu—Cr group alloy.

According to an eleventh aspect of the present invention, there is provided a core used in a hot-top type continuous casting machine, in which the coolant is water.

According to a twelfth aspect of the present invention, there is provided a core used in a hot-top type continuous casting machine, in which the lubrication oil is rape seed oil or castor oil.

DESCRIPTION OF PREFERRED EMBODIMENTS OF THE INVENTION

Description will be hereinbelow made of a hot-top type continuous casting machine using a core, for a hollow billet, according to the present invention in specific forms with reference to the drawings.

Figure 1:
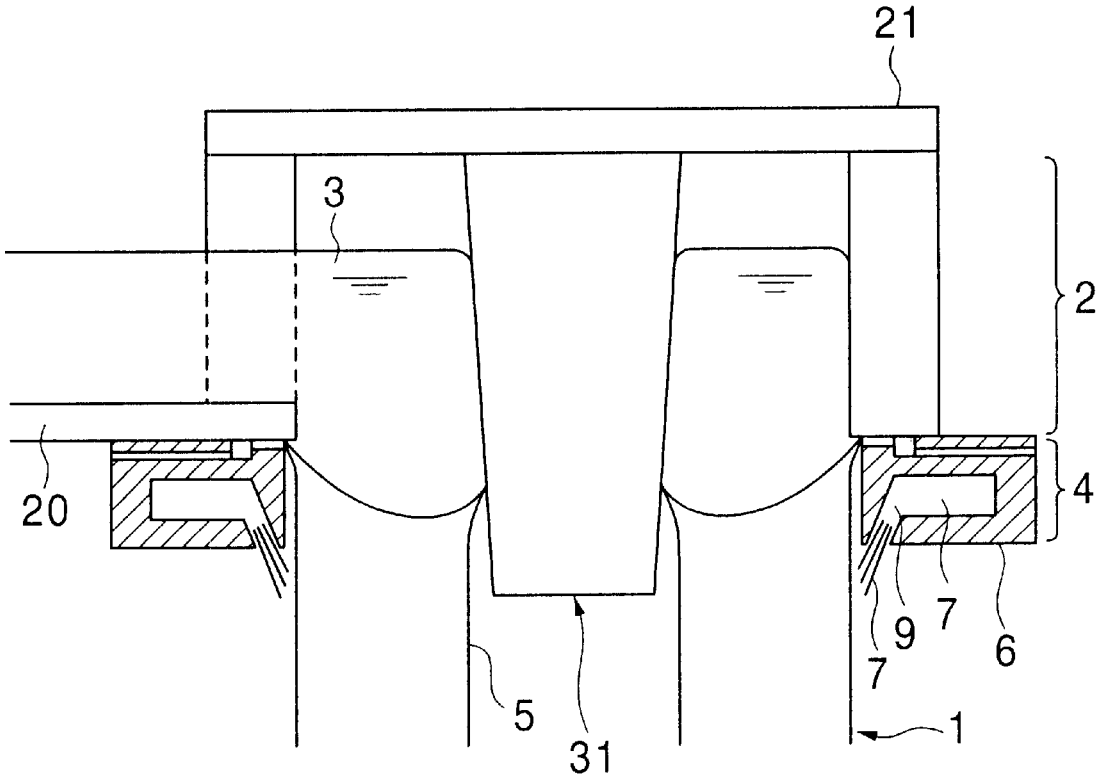
FIG. 1 PRIOR ART
FIG. 1 is a longitudinal sectional view illustrating a conventional hot-top type continuous casting machine.
Figure 2:
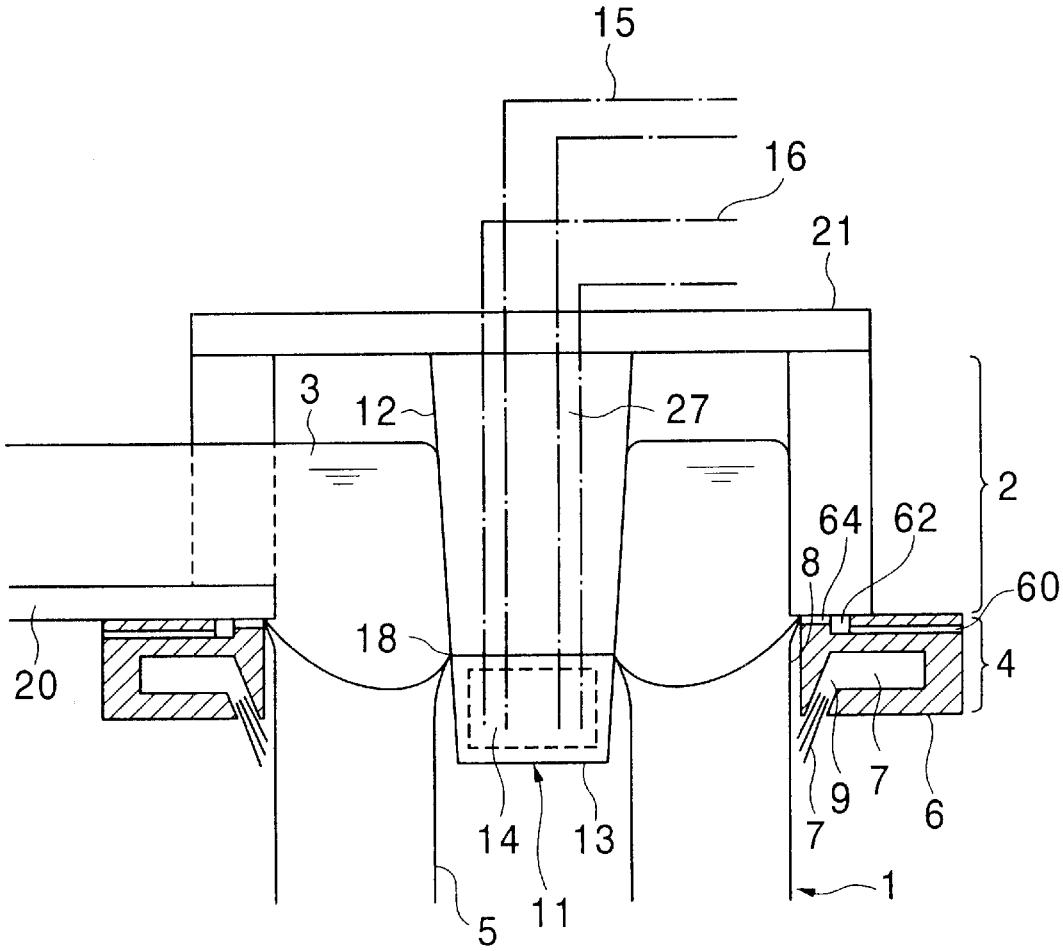
FIG. 2 is a longitudinal section view illustrating a hot-top type continuous casting machine using a core, for a hollow billet in an embodiment of the present invention.

Referring to FIG. 2 which is a longitudinal sectional view illustrating an embodiment of a hot-top type continuous casting machine using a core, for a hollow billet, according to the present invention.

The continuous casting machine according to the present invention is basically composed of a molten metal holding part 2, a mold part 4 and a core 11. The molten metal holding part 2 is always replenished with molten metal 3 through a trough 20, and constitutes a hot-top 2 composed of a refractory material.

The mold part 4 is arranged being connected to the hot top 2, that is, the molten metal holding part 2, and is formed of an ring mold 6 which is cooled in its interior with coolant. Further, the core 11 is fixed to a support part 21, and is inserted in the ring mold 6 from thereabove. The core 11 is composed of a low heat-conductive upper core 12 and a high heat-conductive lower core 13. As mentioned above, the hot-top type continuous casting machine for producing a hollow billet 1 casts the molten metal 2 retained in the molten metal holding part 2, into the mold part 4 therebelow. The mold part 4 is composed of the ring mold 6 defining the outer peripheral surfaced of the hollow billet 1 and the core 11 defining the inner peripheral part thereof.

The interior of the ring mold 6 is cooled by the coolant 7 which is desirably water, and accordingly, the molten metal 3 is cooled (for primary cooling) at the inner surface of the ring mold 6 so as to solidify. Thus, the outer peripheral surface 8 of the hollow billet is formed. Thereafter, the coolant 7 which has cooled the ring mold 6 and which is usually water, is jetted onto the surface of the billet under the mold through a coolant jet port 9 (for secondary cooling) in order to promote solidification of the molten metal.

The ring mold 2 is usually formed in its inner surface in the vicinity of the top part thereof (about 1 mm from its top surface) with a lubrication oil supply passage 60, a supply groove 62 for feeding the lubrication oil over the entire periphery of the mold, and a slit 64 for feeding the lubrication oil onto the inner surface of the mold. The lubrication oil such as rape seed oil or castor oil is fed through this slit in order to maintain satisfactory lubrication between the inner surface of the ring mold 6 and a solidified shell.

Figure 3:
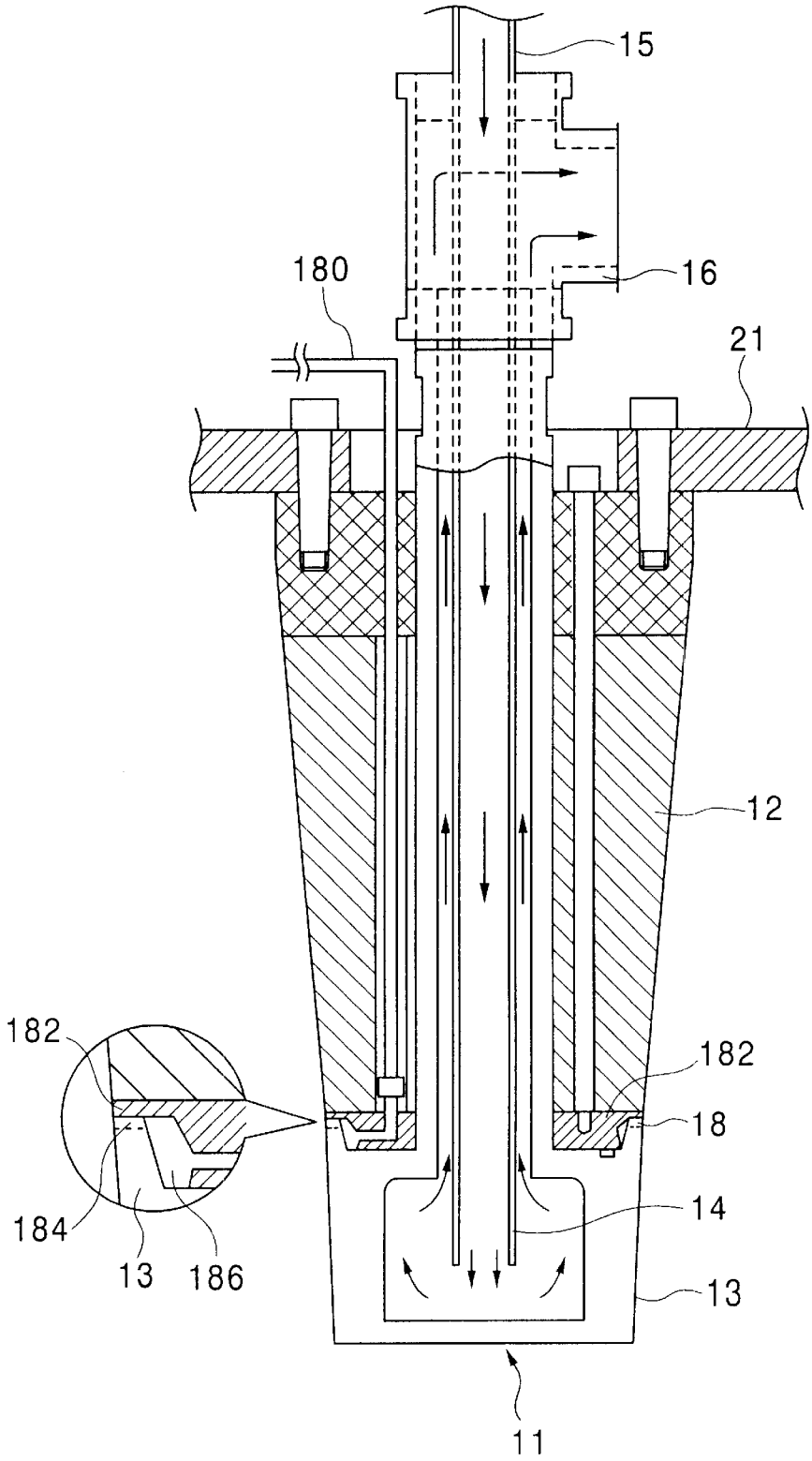
FIG. 3 is a detailed sectional view illustrating the core according to the present invention.

Referring to FIG. 3 which shows the core 11 in detail, the core 11 is composed of the upper core 12 made of a low heat-conductive material, and the lower core 13 made of a high heat-conductive material such as aluminum alloy, and the lower core 13 is fed with coolant 27 such as water while the upper core 12 is formed therethough with a coolant passage 14. The coolant 27 fed from a coolant pipe 15, flows through the coolant passage 14 so as to cool the interior of the lower core, and thereafter it is discharged through a coolant discharge pipe 16. Since the coolant 27 is prevented from being directly injected onto the inner surface 5 of the hollow part of the hollow billet 1, no risk of explosion would be caused even though the solidified shell would be broken so that the molten metal 3 leaks.

Since the lower core 13 is made of a high heat-conductive material such as aluminum alloy, and is formed therein with the coolant passage 14 through which the coolant 27 flows to cool the lower core 13, the solidified shell is formed at the inner peripheral surface 5 of the hollow part of the hollow billet 1, having a thickness with which the shell cannot be melted again. Further, since the core 11 is tapered so that its diameter is decreased down ward, the solidified shell is prevented from being broken by a friction force between itself and the core. Thus, the inner peripheral surface 5 of the hollow part of the hollow billet 1 can be formed with a high degree of surface quality.

According to the present invention, the upper core 12 is made of a low heat-conductive material such as graphite or a refractory material. As to the refractory material, Marinite (trade name: manufactured by Jones Manbill Co.,), Lumiboard (trade name; manufactured by Nitias Co.,) or Recepal (trade name: manufactured by Nitias Co.,) may be suitably used. These materials are in general so-called as heat-insulation boards having a thermal conductivity of less than 0.2 Kcal/m·hr·deg.C.

The lower core 13 is made of a high heat-conductive aluminum alloy material such as AA6061 alloy or Cu—Cr group alloy. As to coolants 7, 27 fed through the ring mold 6 and the lower core 11, any coolant such as water or air may be used.

A lubrication oil feeder is provided in a boundary part 18 between the upper core 12 and the lower core 13. This lubricant oil feeder is composed of a supply pipe 180 for feeding lubrication oil from the outside, a high heat-conductive upper ring 182 having a slit passage 184 opened to the outer peripheral surface of the core, and a groove 186 for circumferentially distributing the lubrication oil. The lubrication oil is fed onto the outer surface of the lower core 13 through the slit passage 184. When the lubrication oil is fed, satisfactory lubrication can be held between the outer surface of the lower core 13 and inner peripheral surface 5 of the hollow part of the billet, and accordingly, the inner peripheral surface 5 of the hollow part of the billet which is excellent can be stably formed.

The core used for a continuous casting machine for a hollow billet, is composed of the upper core 12 made of a refractory material so as to prevent the molten metal 3 from being solidified, and the lower core 13 made of a metal material and cooled by the coolant circulated therein so as to cause the molten metal to be at once solidified in this lower core 13 in order to form a solidified shell having a thickness which is enough for preventing the shell from being remelted. Thus, the height of the boundary part 18 between the upper core 12 and the lower core 13 should be set with respect to the height of the ring mold 16.

Figure 4A:
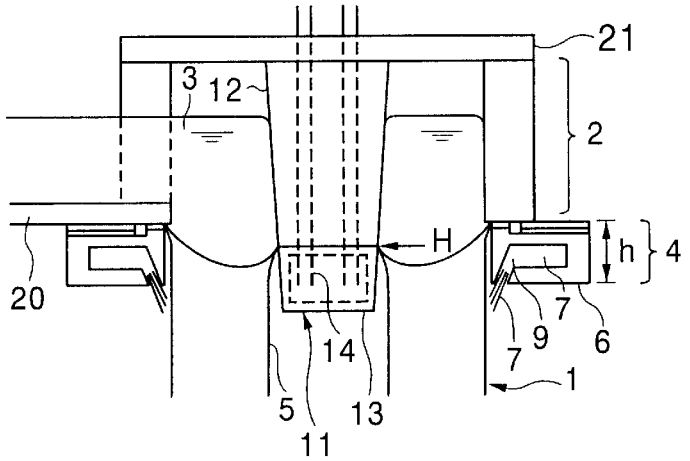
FIGS. 4(A) to 4(C) are views for explaining the height positions of a boundary part between an upper core and a lower core, and an ring mold in the hot-top type continuous casting machine.

That is, as shown in FIG. 4(A), if the heightwise positions of the boundary part 18 and the ring mold 6 are substantially aligned with each other, the surface of the molten metal 3 makes contact with the outer surface of the lower core 13 so that a thick solidified shell is stably formed, and accordingly, the solidified shell would be never remelted, thereby it is possible to obtain an inner surface of the hollow part with extremely high surface quality. It is noted that substantially the same height between the boundary part 18 and the ring mold 6 means that the heightwise position H of the boundary part 18 falls in a heightwise range h of the ring mold 6.

Figure 4B:
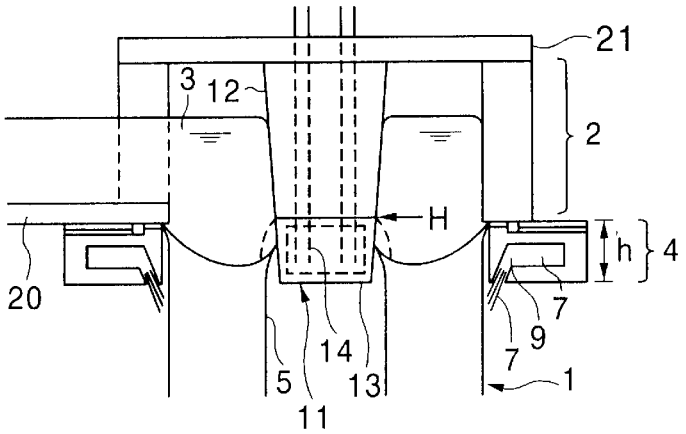

Meanwhile, as shown in FIG. 4(B), the heightwise position H of the boundary part 18 is above the heightwise range h of the ring mold 6, a solidified shell which is initially formed, is remelted by heat from the molten metal in the molten metal holding part 2 so as cause unevenness in the inner peripheral surface 5 of the hollow part, that is, no smooth surface can be obtained.

Figure 4C:
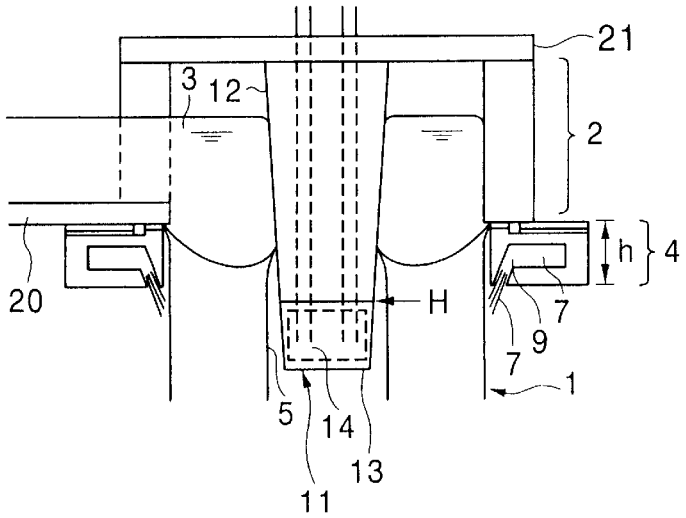

As shown in FIG. 4(C), if the heightwise position H of the boundary part 18 is located below the heightwise range h of the ring mold part 6, the molten metal 3 is solidified at the outer surface of the upper core 2 so as to form a fragile solidified shell, defect is caused on the inner peripheral surface of the hollow part. Thus, it is impossible to obtain a smooth inner surface.

According to the present invention, the casting conditions, including the descending speed of the hollow billet, the volume of cooling water, a temperature of the molten metal also affect upon the quality of the billet, and accordingly, it is necessary to appropriately carry out control for every metal to be cast. Usually, there should be set the descending speed of a hollow billet in a range of 40 to 80 mm/min, the volume of cooling water for the ring mold 6 in a range of 100 to 200 l/min, the volume of cooling water for the lower core in a range of 30 to 60 l/min, and the temperature of molten aluminum alloy in a range of 670 to 750 deg.C.

Figure 5:
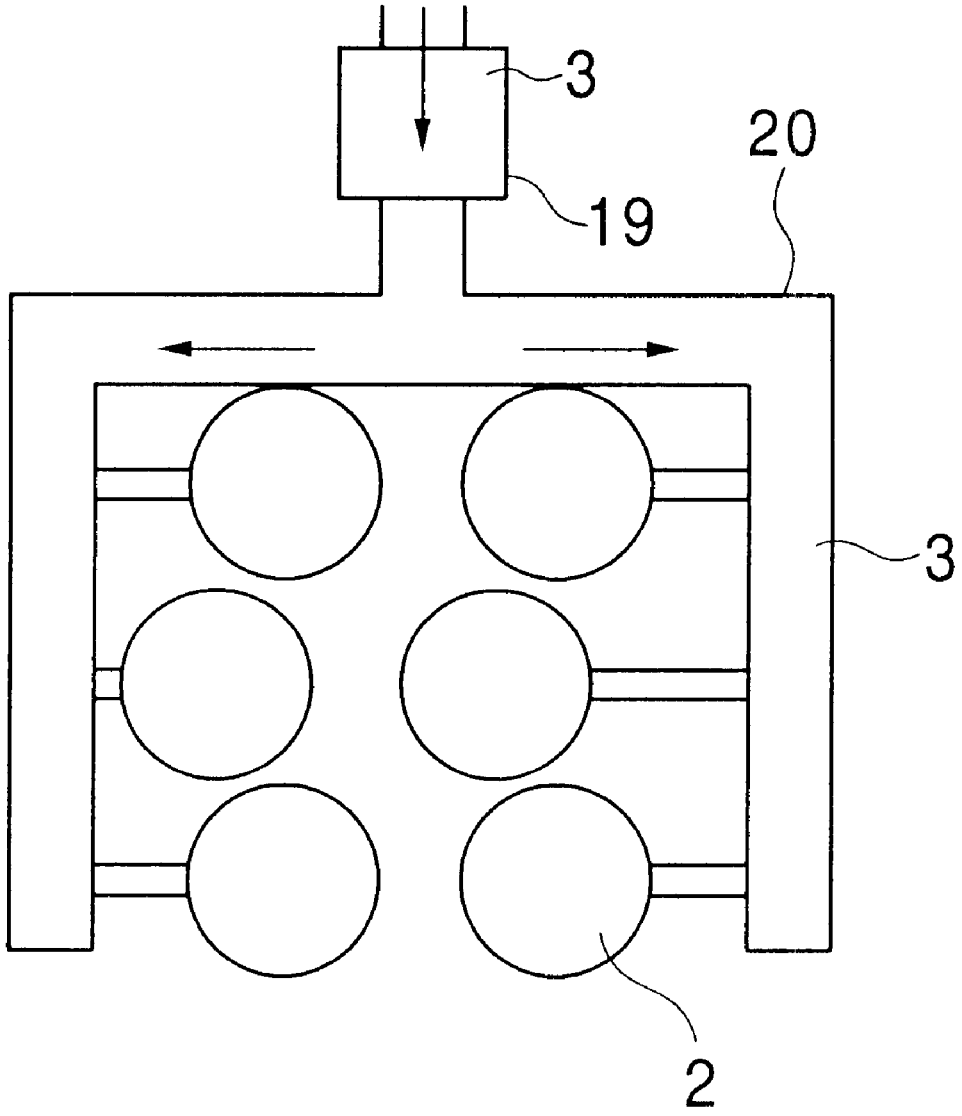
FIG. 5 is a plan view illustrating a configuration of an embodiment in which a plurality of hot-top type continuous casting machines for hollow billets are arranged.

According to the present invention, technical effects and advantage similar to those as mentioned above can be also obtained even though the invention is applied to a hot-top type continuous casting machine for producing several hollow billets, as shown in FIG. 5, in which molten metal 3 fed from a holding furnace (which is not shown) is fed into several molten metal holding parts 3 through a molten metal pool 19 and a channel 20, and several billets are cast from mold parts below the molten metal holding parts 2.

EXAMPLES

Explanation will be hereinbelow detailed in the form of reference examples.

Example 1

Three hollow billets having an outer diameter of 410 mm, an inner diameter of 165 mm and a length of 3 m and made of JIS3003 group aluminum alloy (AA3003) were produced with the use of the hot-top type continuous casting machine for hollow billets, as shown in FIG. 2.

The molten metal holding part 2 and the channel 20 were formed of a heat insulating material manufactured by Recepal Co., and the ring mold 6 having a circular ring shape, in the mold part, was formed of a copper alloy pipe having an inner diameter of 420 mm and a height of 90 mm. As to the core 11, the upper core 12 was made of a heat insulating material manufactured by Recepal Co., and the lower core 13 was made of JIS6061 aluminum alloy (AA6061), and an upper ring 182 having lubrication oil passages opened to the outer peripheral surface of the core was provided in the boundary part 18, the core having an overall length of 400 mm and being tapered (tapering angle of 3 deg.) so as to decrease its diameter downward.

The core 11 was located in the center part of the circular ring mold 6 while the boundary part 18 was located at the center of the heightwise range h of the ring mold 6 (Refer to FIG. 3(A)).

As to casting conditions:

Temperature of Molten Metal in Molten Metal Holding Part 2 (molten metal holding temperature): 730 deg.C.

Descending Speed of Hollow Billet 1: 45 mm/min

Volume of Cooling Water for Ring Mold 6: 170 l/min

Volume of Cooling Water for Lower Core 13: 30 l/min

Example 2

A multiple billet casting machine as shown in FIG. 5 was used to continuously casting six hollow billets having an outer diameter of 410 mm, an inner diameter of 165 mm, a length of 3 m and made of JIS5052 Alloy (AA5052) simultaneously. With the repetitions of such casting by three times, eighteenth hollow billets were obtained.

As to casting conditions:

Temperature for Holding Molten Metal: 690 deg.C

Descending Speed of Hollow billet: 55 mm/min

Volume of Cooling Water for Ring Mold: 170 l/min

Volume of Cooling Water for Lower Core: 30 l/min.

The other conditions were set to those stated in Reference Example 1.

Example 3

A multiple billet casting machines as shown in FIG. 5 were used to continuously casting six hollow billets having an outer diameter of 410 mm, an inner diameter of 165 mm, a length of 3 m and made of JIS6N01 Alloy, simultaneously. With the repetitions of such casting by three times, eighteenth hollow billets were obtained.

As to casting conditions:

Temperature for Holding Molten Metal: 710 deg.C

Descending Speed of Hollow billet: 45 mm/min

Volume of Cooling Water for Ring Mold: 170 l/min

Volume of Cooling Water for Lower Core: 30 l/min.

The other conditions were set to those stated in Reference Example 1.

Example 4

Hollow billets were cast in the method explained in the reference example 1, except that the boundary part 18 was set above (refer to FIG. 2) and below (refer to FIG. 2) the height range h of the ring mold by 10 mm.

Quality of the inner peripheral surfaces of the hollow parts of the hollow billets obtained in the embodiments 1 to 4 were examined. Results obtained through the examination are shown in Table 1.

TABLE 1

| Casting Conditions | No | Height Of Boundary | Cast Alloy (JIS) | Molten Metal Holding Temp. (° C.) | Descending Speed (mm/min) | *Volume of Cooling Water (l/min) | Quality Of Inner Surface of Hollow Part |
|---|---|---|---|---|---|---|---|
| Results of Casting | 1 | Within Range h FIG. 3(A) | 3003 | 730 | 45 | 200 | Extremely Satisfactory |
| | 2 | Within Range h FIG. 3(A) | 5052 | 690 | 55 | 200 | Extremely Satisfactory |
| | 3 | Within Range h FIG. 3(A) | 6N01 | 710 | 45 | 200 | Extremely Satisfactory |
| | 4 | 10 mm above h FIG. 3(B) | 3003 | 730 | 45 | 200 | Almost Satisfactory |
| | 5 | 10 mm below h FIG. 3(C) | 3003 | 730 | 45 | 200 | Almost Satisfactory |

Note:
*Consisting of 170 l/min for the ring mold and 30/min for the lower core.

It is clear from Table 1 that any of the qualities of the inner peripheral surfaces of the hollow parts in the reference examples of the present invention 1 to 3 extremely satisfactory.

However, in reference example No. 4, concavities and convexities were found on the inner peripheral surface of the hollow part since the height H of the boundary part was above the height range h of the ring mold by 10 mm. Further, in the reference example 5, a small number of fine cracks were found in the inner peripheral surface of the hollow part of the boundary part since the height H of the boundary was below the height range h of the ring mold by 10 mm. However, all of them was practically usable.

The above-mentioned reference examples exhibit that there would be no practical problems even though the height H of the boundary part is deviated from the height range h of the ring mold by about 10 mm. It is noted that the quality of the outer peripheral surface of every hollow billet was satisfactory.

As mentioned above, according to the present invention, the core consists of the upper core made of a low heat-conductive material and the lower core made of a high heat-conductive material and cooled by the coolant circulated through the interior of the lower core, and accordingly, a solidified shell can be formed having a thickness with which it cannot be remelted when it is made into contact with the lower core. Thus the quality of the inner peripheral surface of the hollow part becomes satisfactory. Further, since the coolant is directly jetted onto the inner peripheral surface of the hollow part, and accordingly, no explosion is caused even though the molten metal internally leaks. With the provision of the lubrication oil feeder in the boundary part, the lubrication oil is fed onto the outer surface of the core, and accordingly, the quality of the inner surface of the hollow part can be further enhanced. Thus, the hot-top type continuous casting method for a hollow billet according to the present invention with the use of the above-mentioned core can stably produce hollow billets having a high degree of quality. The quality of hollow billets can be further enhanced by setting the height of the boundary between the upper core and the lower core to be equal to that of the ring mold. Thereby the invention is possible to provide industrially remarkable industrial advantages.

EXPLANATION TO REFERENCE NUMERAL

1. Hollow Billet
2. Molten Metal Holding Part
3. Molten Metal
4. Casting Part
5. Inner peripheral surface of Hollow Part of Hollow Billet
6. Ring Mold
7. Coolant Circulated through Ring Mold
8. Outer Peripheral Surface of Hollow Billet
9. Coolant Jet Port in Ring Mold
11. Core according to the Present Invention
12. Upper Core,
13. Lower Core
14. Coolant Passage
15. Coolant Introduction Pipe
16. Coolant Discharge Pipe
18. Boundary Part between Upper Core and Lower Core
19. Molten Metal Sump
20. Trough
21. Support Bar
27. Coolant through Lower Core
31. Conventional Core,
60. Supply Passage for Lubrication Oil
62. Groove for Feeding Lubrication Oil over Entire Periphery of Mold
64. Slit for Feeding Lubrication Oil
180. Lubrication Oil Supply Pipe
182. Lubrication Oil Distributing Groove
184. Slit Passge

What is claimed is:

1. A hot-top type continuous casting machine for casting a hollow billet, comprising:

(a) a molten metal holding part into which molten metal is fed;

(b) a ring mold arranged being connected to the molten metal holding part;

(c) a core, being provided for forming a hollow of the hollow billet, adapted to be inserted downwardly in the ring mold, which comprises a low heat-conductive upper core and a high heat-conductive lower core being adapted to be cooled by a coolant circulated therethrough; and, (d) a passage extending from the top of the core through the core to the lower core for feeding the coolant and another passage extending the top of the core through to the lower core for discharging the coolant to the top of the core after cooling the lower core.

2. The hot-top type continuous casting machine as set forth in claim 1, wherein a boundary between the upper core and the lower core is sct around a position having the same height as that of a position of the ring mold.

3. The hot-top type continuous casting machine as set forth in claim 1, wherein the core, comprising the upper core and the lower core, is formed being tapered from the tops to the bottom of the core with a predetermined slope.

4. The hot-top type continuous casting machine as set forth in claim 1, wherein the lower core is made of a high heat conductive material and the upper core is made of a low heat conductive material.

5. The hot-top type continuous casting machine as set forth in claim 1, further comprising a means for feeding lubrication oil onto an outer surface of the core provided in a boundary between the low heat conductive upper core and the high heat conductive lower core.

6. The hot-top type continuous casting machine as set forth in claim 5, wherein the lubrication oil is rape-seed oil or castor oil.

7. The hot-top type continuous casting machine as set forth in claim 1, wherein the continuous casting machine is a casting machine for casting an aluminum alloy.

8. The hot-top type continuous casting machine as set forth in claim 1, wherein the lower core is made of an aluminum alloy or a Cu—Cr alloy.

9. The hot-top type continuous casting machine as set forth in claim 1, wherein the coolant is water.

* * * * *